United States Patent [19]

Sakurai et al.

[11] 4,296,919

[45] Oct. 27, 1981

[54] APPARATUS FOR CONTINUOUSLY PRODUCING A HIGH STRENGTH DUAL-PHASE STEEL STRIP OR SHEET

[75] Inventors: Koichi Sakurai, Kitakyusyushi; Takashi Furukawa, Machidashi; Hiroshi Takechi, Kisarazushi; Munetsugu Matsuo, Kawasakishi, all of Japan

[73] Assignee: Nippon Steel Corporation, Tokyo, Japan

[21] Appl. No.: 178,015

[22] Filed: Aug. 13, 1980

[51] Int. Cl.[3] ..... C21D 9/56

[52] U.S. Cl. ..... 266/111; 266/102; 266/103; 266/109; 266/113

[58] Field of Search ..... 266/102, 103, 111, 113, 266/106, 109, 249, 252, 259, 274; 226/104, 107, 118, 119; 432/59, 60, 86

[56] References Cited

U.S. PATENT DOCUMENTS

| | | | |
|---|---|---|---|
| 3,194,545 | 7/1965 | Smith | 266/113 |
| 3,252,693 | 5/1966 | Nelson | 266/113 |
| 3,587,276 | 6/1971 | Randich | 226/104 |
| 3,779,054 | 12/1973 | Greenberger | 266/113 |
| 4,165,964 | 8/1979 | Yonezawa et al. | 432/59 |
| 4,239,483 | 12/1980 | Iida et al. | 266/103 |

*Primary Examiner*—L. Dewayne Rutledge
*Assistant Examiner*—John P. Sheehan
*Attorney, Agent, or Firm*—Wenderoth, Lind & Ponack

[57] ABSTRACT

An apparatus for continuously producing a high strength dual-phase steel strip or sheet having a chemical composition which produces a dual-phase structure composed of ferrite grains and a low temperature transformed phase when rapidly cooled from the $(\alpha+\gamma)$ temperature range or from the $\gamma$ temperature range. The apparatus has a continuous heat treatment furnace in which the strip moves vertically and which is composed of a heating zone, a soaking zone and a cooling zone, and conventional equipment associated therewith. The cooling zone has an upper hearth roll group, a lower hearth roll group and cooling equipment for cooling the strip at a rate in the range between 1° and 300° C./sec. for retaining the austenite in the steel of the strip. The hearth rolls of each hearth roll group are arranged to guide the strip coming from the soaking zone up and down through the cooling zone from the inlet end to the outlet end, alternately passing around the upper hearth rolls and the lower hearth rolls. The hearth roll at the position where the strip is subjected to straining and begins to work harden as a result of the bending, and the hearth rolls subsequent to such position, have diameters such that the strain induced phase transformation of the retained austenite and consequently the work hardening of the strip when it is turned around the hearth rolls is avoided.

3 Claims, 7 Drawing Figures

$\alpha = 2$ $\alpha = 1$

APPARATUS FOR CONTINUOUSLY PRODUCING A HIGH STRENGTH DUAL-PHASE STEEL STRIP OR SHEET

BACKGROUND OF THE INVENTION

1. Field of the Invention

The present invention relates to an apparatus for continuously producing a high strength dual-phase steel sheet or strip with a low yield-to-tensile strength ratio (hereinafter called simply "low yield ratio").

In the automobile industry, efforts are constantly being made to reduce the fuel consumption of cars by reducing the weight of car bodies by using high-tensile strength steel sheets. As a result, there has long been a demand in the automobile industry for steel sheets having excellent formability, particularly low yield strength, high elongation and high tensile strength.

The demand for such steels has been particularly high in the U.S.A. where the auto producers are under a legal obligation to reduce car fuel consumption.

To produce a high strength steel sheet having a low yield ratio, there is used as the starting material either a low carbon microalloyed steel or an ordinary steel having C, Si and Mn as the main alloying elements and without additional special alloying elements such as Nb, V, Ti etc. The material is heated and kept in the temperature range above its $A_3$ point for a short time, namely in the gamma temperature range, or in the temperature range from the $A_1$ point to the $A_3$ point, namely in the alpha-gamma temperature range, and cooled at a cooling rate greater than the critical value so as to obtain a dual-phase consisting of polygonal ferrite grains ($\alpha$) and finely divided and uniformly dispersed low temperature transformed phase or phases (at least one of bainite and martensite, often with retained austenite). Such dual-phase steels having 50–80 kg/mm$^2$ tensile strength have been recognized as most suitable for automobile bodies since they can be produced with good consistency by a rather simple production process.

In one conventional apparatus for continuously treating steel strips such as the above type of high strength steel and having a thick gauge, there is used a so-called horizontal treating furnace, as exemplified by the annealing and pickling line (A.P.L.) used for annealing stainless steel strips. This conventional type of apparatus has a disadvantage that the furnace, which is constituted by a heating zone, a soaking zone and a cooling zone, must have a considerable length in order to provide a large-capacity, high-speed production line suitable for mass production. The length of the furnace requires a long shop, which in turn requires a large capital outlay.

Further, because the furnace atmosphere is open to the ambient air, the steel strips being treated therein are very likely to be oxidized. Thus, for removal of the resulting oxide film, it is necessary to provide an acid pickling section composed of an acid pickling tank, a brush scrubber, a neutralizing tank, a hot water rinsing tank and a drying device following the furnace.

2. Summary of the Invention

One object of the present invention is to overcome the disadvantages of the conventional apparatus as described above and to provide a simple and compact apparatus suitable for continuously producing a high strength dual-phase steel sheet having a low yield ratio, which apparatus has a short length and which does not require an acid pickling section.

Another object of the present invention is to provide an apparatus for continuously producing dual-phase steel sheet or strip, which apparatus has a large production capacity and is thus highly desirable for meeting the recent large demand for such steels.

BRIEF DESCRIPTION OF THE DRAWINGS

FIG. 3(*b*) is a graph showing the work hardening coefficient (n) of a dual-phase steel sheet as calculated from FIG. 3(*a*) and, by way of comparison, that of a mild steel sheet;

DETAILED DESCRIPTION OF THE INVENTION

Figure 1:
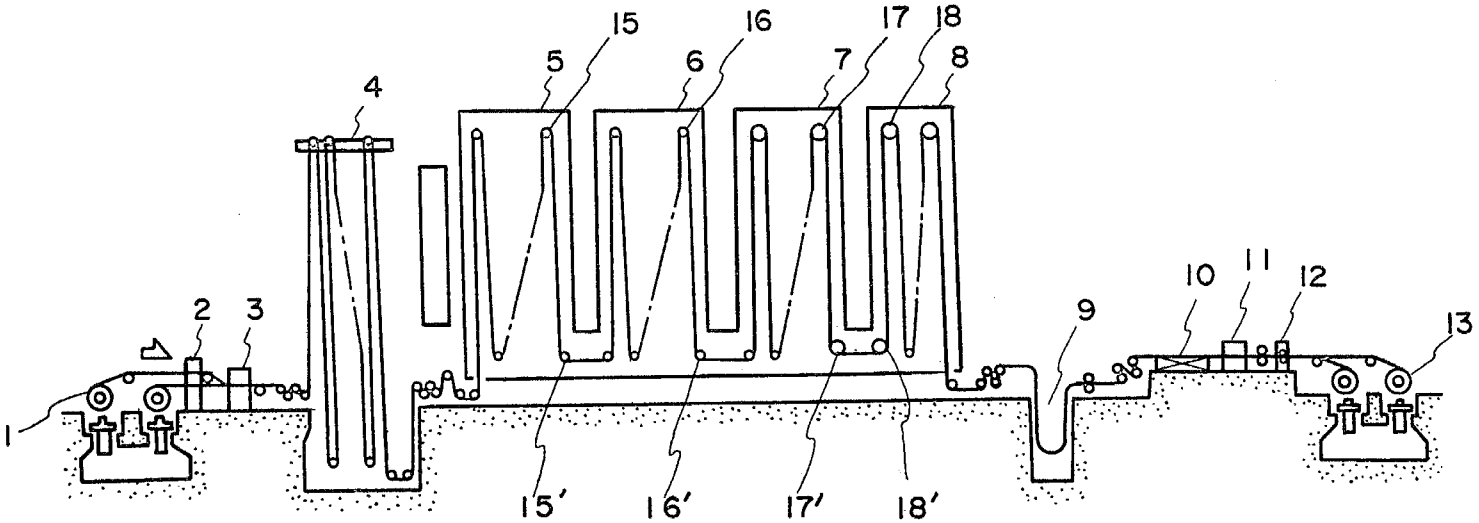
FIG. 1 is a schematic view of the apparatus according to the present invention.

As shown in FIG. 1, the apparatus according to the present invention comprises an uncoiler 1, an inlet-end shearing machine 2, a welder 3, an inlet-end looper 4, a heating zone 5, a soaking zone 6, a primary cooling zone 7, a secondary cooling zone 8, an outlet-end looper 9, an inspection section 10, an oil coater 11, an outlet-end shearing machine 12 and a coiler 13.

One of the main aspects of the present invention relates to the heat treating furnace part of this apparatus which comprises the heating zone 5, the soaking zone 6, the primary cooling zone 7 and the secondary cooling zone 8.

The furnace of the present invention is for producing a dual-phase steel sheet or strip, and the heat treating furnace according to the present invention is so constructed as to subject the steel strip to a heat treatment cycle which comprises heating the strip to the $\gamma$ range or the $(\alpha+\gamma)$ range in a short time, to hold the strip within said range or ranges for a short period of time, to cool the strip at not less than a predetermined cooling rate, so as to produce polygonal ferrite grains ($\alpha$) and finely divided and uniformly dispersed low temperature transformed phase or phases, and then to cool the strip to or below the surface oxidation temperature in air.

Figure 2:
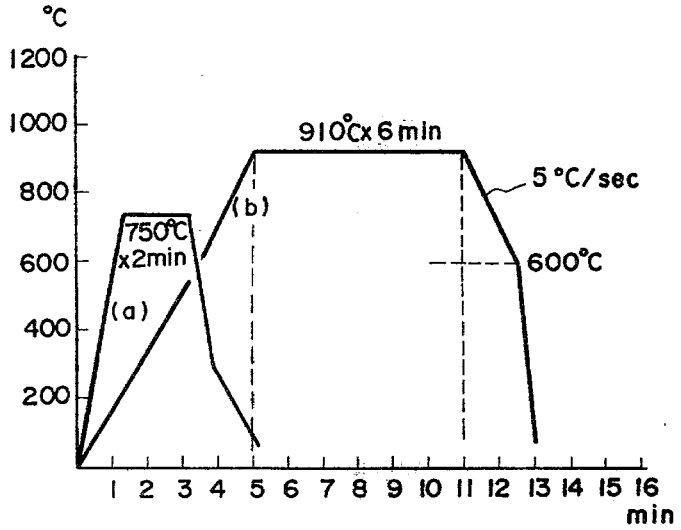
FIG. 2 is a graph showing one example of a heat treatment cycle of a dual-phase steel sheet.

In the graph of FIG. 2, curve (a) shows one example of a heat treatment cycle for heating Al-Si killed dual-phase steels having a tensile strength at the 55 kg/mm$^2$ level and a composition of C: 0.089%, Si: 0.43%, Mn: 1.54%, P: 0.015%, S: 0.005%, Al: 0.023% and the balance Fe to the alpha-gamma temperature range. This heat treatment cycle, when applied to the dual-phase steel sheet of the type which is produced by the present invention, can have a soaking temperature between 723° C. and 900° C., a holding time between 30 seconds and 5 minutes, and a cooling rate sufficient to produce the low temperature transformed phase or phases when the sheet is cooled from the soaking temperature to a temperature between about 200° C. and about 300° C. and which is, for example, chosen in the range of from between 1° C./second and 300° C./second at a mean cooling rate according to the composition and thickness of the steel sheet being treated.

In FIG. 2, curve (b) shows one example of a heat treatment cycle for heating a low-carbon vanadium-containing dual-phase steel having a tensile strength at the 65 kg/mm$^2$ level and a composition of C: 0.11%, Si: 0.40%, Mn: 1.60%, V: 0.05%, P: 0.008%, S: 0.004%, Al: 0.025%, N: 0.001% and the balance Fe to the gamma single-phase temperature range. This heat treatment cycle, when applied to the dual-phase steel sheet of the type which is produced by the present invention, comprises soaking at a temperature exceeding 900° C. but not more than 1000° C. for between one minute and 10 minutes, and mild cooling at a cooling rate which permits partitioning of the alpha and gamma phases when the sheet is cooled from the soaking temperature to about 600° C., for example, a mean cooling rate from 1° C./second to 100° C./second depending on the chemical composition and thickness, and further cooling from about 600° C. to between 100° C. and about 300° C. at a cooling rate sufficient to form the low temperature transformed phase or phases, for example, a mean cooling rate from 1° C./second to 300° C./second.

To allow the apparatus to carry out the aforementioned heat treatment cycles, the heating zone 5 is provided with an upper hearth roll group 15 and a lower hearth roll group 15' and the strip is passed up and down and alternately around the upper hearth rolls and the lower hearth rolls while the strip travels from the inlet end to the outlet end. While travelling in this manner, the strip is heated to a temperature between 723° C. and 900° C., namely to the $(\alpha+\gamma)$ temperature range in 3 minutes or less, or to a temperature exceeding 900° C. but not more than 1000° C. ($\gamma$ temperature range) in ten minutes or less. The heating is preferably done by means of radiant tubes, but other heating means such as electric heating means and non-oxidizing direct fired heating means can also be employed in order to prevent or suppress formation of an oxide film on the strip surface.

When a non-oxidizing direct fired furnace is used, particularly when a steel strip containing easily oxidizable elements, such as Si or Mn, is treated in the furnace, consideration must be given to fuel selection and air ratio adjustment in each of the zones. For treating products requiring paintability in a radiant tube furnace, a cleaning section, including some or all of an alkali dunk tank, an alkali scrubber, an alkali electrolysis tank, a hot water rinsing tank and a drying device, must be provided at the furnace inlet for removing the rust preventive oil or the cold rolling lubricant. On the other hand, the non-oxidizing furnace has the advantage that, if properly used, the cleaning section can be omitted.

In the soaking zone 6, an upper hearth roll group 16 and a lower hearth roll group 16' similar to those in the heating zone are provided in a vertical arrangement so that the strip coming from the heating zone passes up and down alternately around the upper hearth rolls and the lower hearth rolls while travelling from the inlet end to the outlet end of the zone. During this travel, the strip is maintained at a temperature between 723° C. to 900° C. for a period from 30 seconds to 5 minutes or at a temperature exceeding 900° C. but not more than 1000° C. for 1 to 10 minutes. The heating in this zone is preferably carried out by an electric resistance indirect heating means, but other heating means may also be employed, sometimes together with a reducing atmosphere.

The primary cooling zone 7 is provided with an upper hearth roll group 17 and a lower hearth roll group 17'. These groups of hearth rolls are arranged in such a manner that the strip coming from the soaking zone 6 at a temperature between 723° C. to 900° C. is cooled to about 200° C. to 300° C. at a cooling rate of between 1° C./second and 300° C./second as it passes up and down and alternately around the upper and lower hearth rolls. For the cooling means carrying out cooling at the above cooling rate, a gas jet cooler, which does not produce any oxide film on the strip surface, is preferable, but other cooling means, such as an atomized gas fog (hereinafter called simply "mist") cooling, boiling water cooling or metal contact cooling means may be employed separately or in combination. The reasons for using such cooling means will be discussed below.

The cooling rate attained by each cooling means is as shown in the following table:

| Cooling means | Cooling rate | Remarks |
|---|---|---|
| Gas jet cooling | about 5-50° C./S | |
| Mist cooling | about 15-300° C./S | Surface oxidized |
| Boiling water cooling | about 100-300° C./S | |
| Water cooling | about 1000-2000° C./S | |
| Metal contact cooling | about 10-200° C./S | |

Therefore, the preferable cooling rate (1°-300° C./S), which produces a product with good formability as described above, can be obtained with a gas jet, mist, boiling water or metal contact cooling means, but not with a water cooling means.

More specifically, (i) Gas jet, mist or metal contact cooling means is preferable for producing a steel strip having high ductility, which requires a cooling rate of 15°-50° C./second.

(ii) Mist, boiling water or metal contact cooling means is preferable for conserving alloying element content by employing a cooling rate of 50°-300° C./second.

In addition, as shown in the above table, the gas jet cooling means has another advantage in that with such means no acid pickling section is required in spite of the normal tendency for strips containing Mn, Si, etc. to be oxidized during the cooling step.

This range of cooling rates can be covered by gas jet cooling means, mist cooling means, boiling water cooling means and metal contact cooling means.

Figure 5:
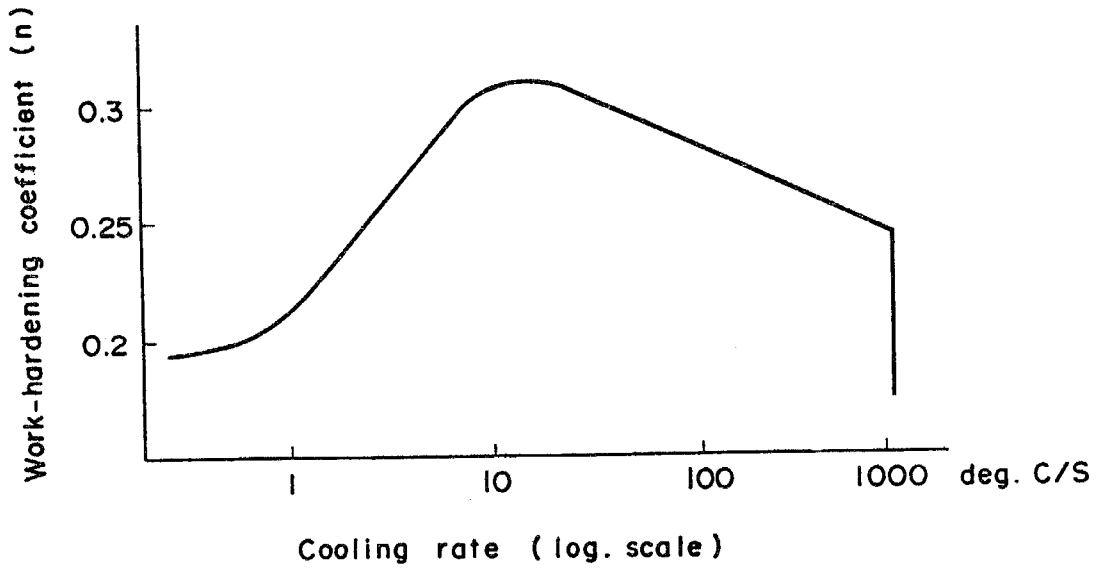
FIG. 5 is a graph showing the variation in work hardening coefficient (n) at small strain with variation in the primary cooling rate.

The mechanical properties of dual-phase steel vary in accordance with the primary cooling rate. FIG. 5 shows the effect of the cooling rate on the work hardening coefficient (n).

In the slow cooling procedure, the austenite is susceptible to decomposition into carbides, which lowers the strength of the second phase and the work hardening coefficient.

In the rapid cooling procedure, the work hardening rate is relatively high. However, the second phase particles are so hard that the materials have to be tempered by a tempering treatment to ensure necessary ductility.

The work hardening characteristics are well correlated with the low temperature transformed products. The highest work hardening coefficient is obtained when the austenite is retained. The retained austenite promotes high work hardening due to the strain induced transformation into martensite during plastic deformation. The gas jet cooling process, which gives a cooling rate between 1° and 100° C./second, is favorable for retention of austenite because it promotes austenite stabilization and produces little thermal stress during cooling.

Similarly, the secondary cooling zone 8 is provided with an upper hearth roll group 18 and a lower hearth roll group 18', and the strip coming from the primary cooling zone passes up and down and alternately around the upper hearth rolls and the lower hearth rolls while the strip is cooled to 200° C. or lower. As in the primary cooling zone, a gas jet cooler or other cooling means is used. For bright cooling a gas jet cooler is recommended, but any water cooling tank may be used as long as it is provided with a surface oxidation preventive means. When using water cooling, a drying device must also be provided.

The oxide film which may be formed on the strip surface when mist-cooling means or boiling water quenching means is used in the primary cooling zone as described hereinbefore, is removed by an acid pickling line (including a neutralizing or rinsing tank) provided adjacent to the secondary cooling zone.

Another feature of the present invention is that the heating zone 5, the soaking zone 6, the primary cooling zone 7 and the secondary cooling zone 8 are in communication with each other and are each isolated from the surrounding atmosphere. All these zones are provided with a non-oxidizing atmosphere. One example of a non-oxidizing atmosphere that can be used as an economical bright annealing atmosphere is $N_2$ containing 1 to 20% $H_2$.

A still further feature of the present invention is that the diameters of the hearth rolls in the cooling zones and the rolls in the equipment at the outlet end of the cooling zones are selected to satisfy the Formulas I and II set forth below so as to prevent the yield point of the final product from being increased due to workhardening caused by repeated bending of the strip around the hearth rolls in the cooling zones and the rolls in the equipment at the outlet end of the cooling zones after the formation of the low temperature transformed phase in the cooling zone. The diameter requirement of the hearth rolls and the rolls in the further equipment is very important for production of a dual-phase steel strip, and a more detailed explanation of this point will be given hereinbelow with reference to FIG. 3(*a*) and showing the stress-strain curves of a dual-phase steel sheet and of an ordinary high tensile strength steel strip.

The mechanical properties of these two types of strips are set forth below.

| | YP kg/mm$^2$ | TS kg/mm$^2$ | U.El % | T.El % | n | YP/TS |
|---|---|---|---|---|---|---|
| Ordinary High Tensile Strength | 54.1 | 66.0 | 15.0 | 23.3 | 0.18 | 0.81 |
| Dual Phase Structure Steel | 29.6 | 62.6 | 21.0 | 31.5 | 0.30 | 0.47 |

YP : Yield Point
TS : Tensile Strength

Figure 3:
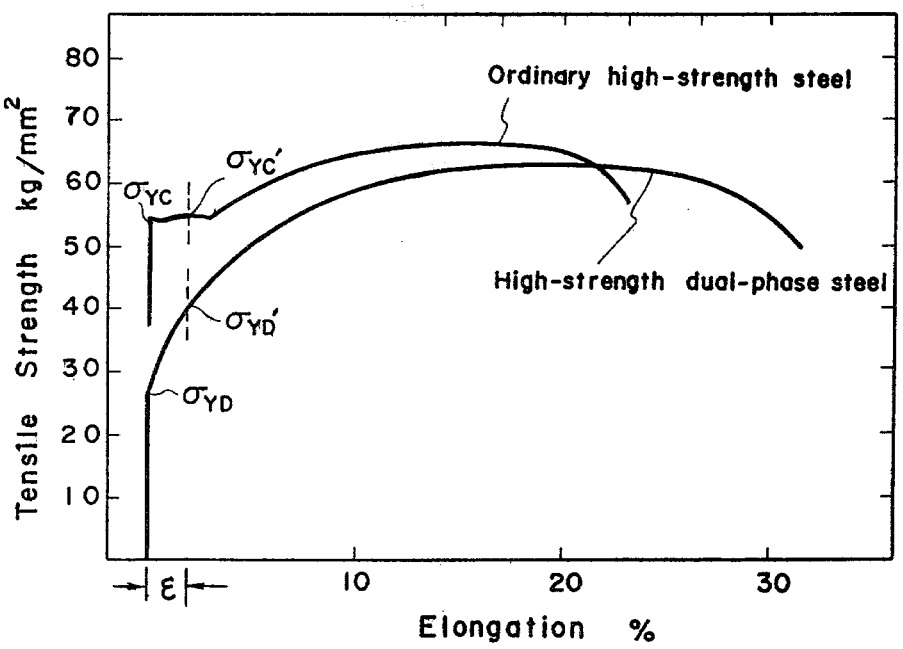
FIG. 3(*a*) is a graph showing the stress-strain curves for a dual-phase steel and, by way of comparison, those for an ordinary high tensile strength steel sheet.
Figure 3:
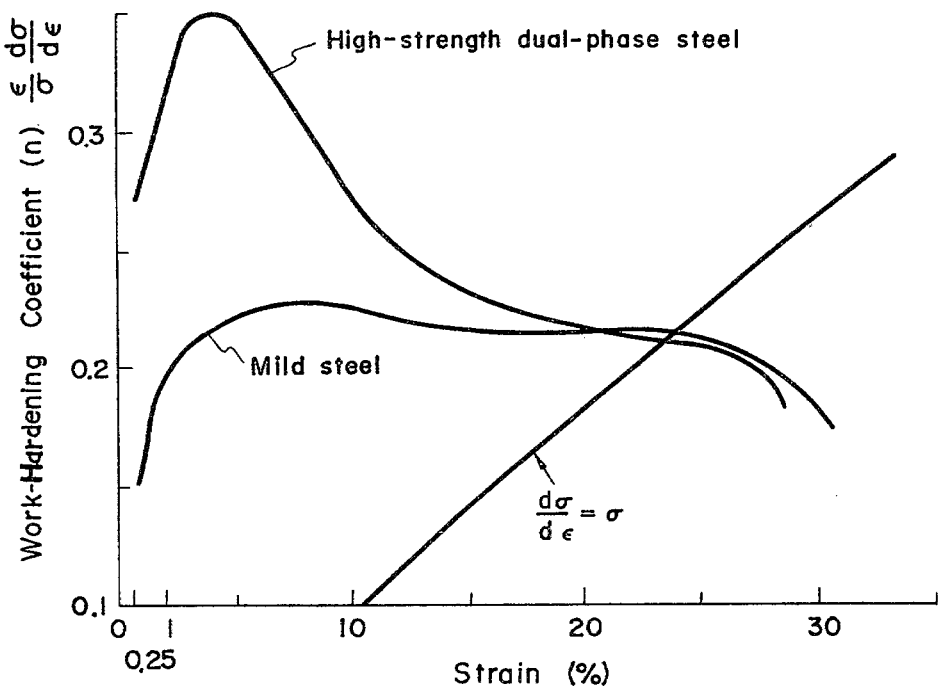

In FIG. 3(*a*), $\sigma_{Yd}$ represents the yield strength of dual-phase steel, and $\sigma_{YC}$ represents the yield strength of ordinary high tensile strength steel. In the case of ordinary high tensile strength steel, because the work hardening rate (n value) is low (about 0.2), when only a slight strain $\epsilon$ is added, the yield strength shows only a slight increase toward $\sigma_{YC}$, and there is not a very great influence on the quality of the product. In the case of the dual-phase steel, because the n value is high, the yield strength increases considerably to $\sigma_{YD}$, even with a small strain $\epsilon$. Therefore, when the diameter of the hearth rolls in and after the cooling zone, and the diameter of the outside looper rolls and the brindle rolls etc. are not proper and, as a consequence, the dual-phase steel is given a small strain, the yield strength of the product increases so much that all the advantageous properties of a low-yield strength steel are completely lost. Thus, the determination of the proper diameter of the rolls in and after the cooling zone is very important for the apparatus for producing a dual-phase steel. Accordingly, in the present invention, the diameter of the rolls in and after the cooling zone is defined to satisfy the following Formulas I and II.

The manner of determining the diameter of the hearth rolls for treating a dual-phase steel will be explained hereinbelow.

The most salient feature of a dual-phase steel is that it shows a markedly low yield strength in spite of its high tensile strength. In other words, the steel has a very large work hardening rate when its strength increases along with an increase of strain, as shown in FIG. 3(*b*).

Therefore, as indicated above, in the production of a dual-phase steel it is necessary to avoid introduction of a strain into the strip. For example, one conventional way for obtaining a super mild steel sheet uses a hearth roll of a selected diameter in the ordinary annealing line so as to introduce an appropriate strain into the sheet, thereby promoting precipitation of carbon and nitrogen and hence softening the steel. However, this conventional prior art method cannot be employed for production of a dual-phase steel, because if strain is applied, the yield strength increases, meaning that the most salient feature inherent in the dual-phase steel is lost.

On the other hand, if the deformation is 0.2% or less, the permanent strain induced is not large and only slightly exceeds the maximum elastic strain. An electron microscopy study revealed that a strain of 0.2% or less causes no increase in the dislocation density. On the other hand, when a strain larger than 0.2% is given to the steel, it introduces a plastic strain and substantially greater work hardening takes place than in a mild steel. In such a steel the yield strength increases several kilograms/mm$^2$ for each 1% stain increase and thus it is impossible to obtain a satisfactory quality of the dual-phase steel. Thus, in order to be certain of retaining the inherent feature of the dual-phase steel without increasing the yield strength, it is required to limit the strain to 0.2% or less.

The above requirements must also be satisfied at rather high temperatures, insofar as a dual-phase structure has already formed during cooling. It has been confirmed that if the strain is 0.2% or less, the yield strength will not increase.

In connection with this critical limit on strain, the primary cooling rate after annealing should be adequately controlled in order to obtain and retain a suitable metallographic structure. The microstructures and the mechanical properties of dual-phase steel vary in accordance with the primary cooling rate. FIG. 5 shows the variation in the amount of retained austenite with change in cooling rate. With slow cooling, i.e. at a rate of less than 1° C./second, the austenite decomposes into ferrite and carbide thereby lowering the strength and the work hardening rate of the strip. With rapid cooling, i.e. at a rate of more than 300° C./second, the austenite cannot be retained because of the significant amount of quenching stress, and the martensite phase particles are so hard that the strip has to be tempered for ensuring the necessary ductility. With moderate cooling, i.e. in the range between 1° and 300° C./second, a substantial amount of austenite is retained because of the effect of austenite stabilization and the small thermal stress during the cooling.

The retained austenite is a very important microstructural constituent in dual-phase steel. The retained austenite undergoes strain induced transformation into martensite when the dual-phase steel sheets are formed into various articles such as autobody panels. The strain-induced transformation, which is analogous to the superplasticity found in TRIP (transformation induced plasticity) steels, contributes to the high work hardening and the high resistance to fracture characteristics of dual-phase steel. Thus in the production process, care should be taken to minimize the strain induced phase transformation during the production process by controlling the cooling rate and the amount of strain during the bending as the steel strip passes over the rolls.

Austenite is found to be retained in strip subjected to a moderate cooling rate which can be attained by means of gas jet cooling, mist cooling, boiling water cooling and metal contact cooling. The cooling rate determines the stress induced in the strip, and the stress leads to the strain induced transformation of austenite. Therefore, the critical strain caused by the bending around the rolls must be adjusted by taking into account the effect of the cooling rate. It has been confirmed that the adjustment can be made by adding to the stress due to bending around the rolls a term which consists of a multiple of the thermal expansion coefficient, the logarithm of the cooling rate, the inverse of the strip thickness, and the temperature at which the strip has been subjected to cooling.

The amount of stress introduced in the strip by cooling is determined by the dimensional change because of thermal contraction. The dimensional change is proportional to a multiple of the thermal expansion coefficient and the temperature drop during rapid cooling. Since the stress can be relieved during cooling by slow cooling, the magnitude of stress retained in the strip depends upon the cooling rate. Therefore, the thermal stress, to which the stress due to bending must be added, is a function of the temperature drop and the cooling rate; the thermal expansion coefficient being a constant. In comprehensive studies by use of X-ray diffraction for determination of the residual stress and the amount of retained austenite, the stress, $\sigma c$, was found to be formulated approximately according to the following expression:

$$\sigma c = \beta \cdot T \cdot \log (CR) \cdot \frac{1}{100}$$

wherein:

$\beta$ = Linear thermal expansion coefficient;

T = Temperature at which the strip is subjected to cooling, in degrees C;

CR = Cooling rate of the strip in degrees C/second.

Furthermore, as a result of extensive observations of the characteristics of transformation behavior by using X-ray diffraction and Mössbauer spectroscopy, it has been found that the retained austenite undergoes strain induced transformation at a strain higher than 0.2% where the work hardening of the strip starts. Therefore, for a given thickness of the strip, the diameter of the hearth rolls and the cooling rate should be maintained within the range defined by the following formulas [I] and [II]:

$$\frac{t}{D} + \beta \cdot T \cdot \log (CR) \cdot \frac{1}{100} \leqq \epsilon WH \qquad [I]$$

wherein;

D = Diameter of the hearth roll in millimeters;

t = Maximum strip thickness in millimeters;

$\epsilon$WH = 0.2% (Strain at which the retained austenite starts to undergo strain induced transformation into martensite and the strip begins to work harden);

$\beta$ = Linear thermal expansion coefficient ($12 \times 10^{-6}$);

T = Temperature at which the strip is subjected to cooling, in degrees C;

CR = Cooling rate of the strip in degrees C/second.

Formula [I] is mainly useful for the hearth rolls in the cooling zone where the sheet temperatures are still rather high, e.g. about 200° C. or higher.

$$\frac{t}{2D'} + \beta \cdot T \cdot \log (CR) \cdot \frac{1}{100} \leqq \epsilon WH \qquad [II]$$

wherein;

D' = Roll diameter in the further equipment in millimeters;

t = Maximum strip thickness in millimeters;

$\epsilon$WH = 0.2% (Strain at which the retained austenite starts to undergo strain induced transformation into martensite and the strip begins to work harden);

$\beta$ = Linear thermal expansion coefficient ($12 \times 10^{-6}$);

T = Temperature at which the strip is subjected to cooling, in degrees C;

CR = Cooling rate of the strip in degree C/seconds.

Formula [II] is mainly useful for the rolls in the further equipment where the sheet temperatures are low. The difference between the Formulas [I] and [II] stems from the dependence of the distribution of the strain in the thickness direction of the sheet passing around the rolls upon the sheet temperature, which will be explained in detail later (in the explanation of Formula [III]).

As a specific illustration, when the strip thickness is 3 mm and $\epsilon$WH is 0.2%, the diameter of the hearth roll calculated from Formula [I] is no smaller than 1500 mm ($\geqq$1500 mm). The roll diameter in the further equipment calculated by the Formula [II] is D'$\geqq$750 mm.

For economical preparation of a number of heat-resistant large diameter rolls for use in the cooling zone, it is advantageous to use a welded roll made from steel boiler plate.

Still another feature of the present invention lies in the provision of a large diameter guide roll in the looper at the inlet end of the apparatus. Since mechanical properties of dual-phase steel are determined by soaking temperature and the cooling rate in the continuous annealing process, the diameter of the guide roll at inlet end can be determined simply by the operational requirements. Moreover, a large diameter hearth roll is used at the inlet end of the heating zone in order to avoid occurence of buckling caused by repeated bending around the inlet looper guide rolls and the hearth rolls at the inlet end of the heating zone. Thus the diameter of these rolls must satisfy the following formula [III]:

$$\frac{D''}{t} \geqq \frac{E}{\alpha(\sigma_Y - S)} \quad [III]$$

wherein;

D''=Diameter of the guide roll or the hearth roll at the inlet end in millimeters;

t=Maximum strip thickness in millimeters;

E=Young's modulus;

$\sigma_Y$=Yield stress of steel strip;

S=Tension in the production line in kg/mm$^2$ $\alpha$=Coefficient (1 or 2; determined by the friction conditions between the strip and the guide roll or the hearth roll).

The coefficient $\alpha$ is selected as described below.

Figure 4:
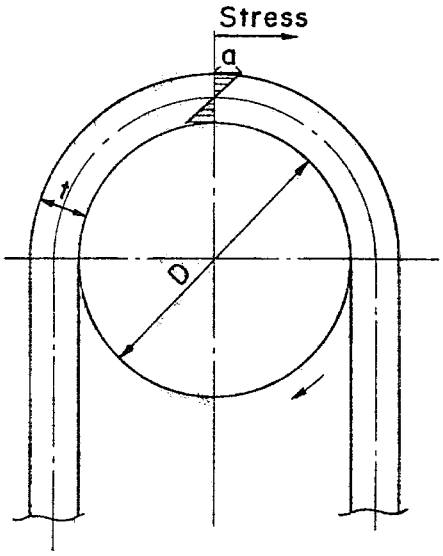
FIGS. 4(*a*) and 4(*b*) are diagrams showing the position of the neutral axis of the bending of a steel strip while the strip is passing around a hearth roll.
Figure 4:
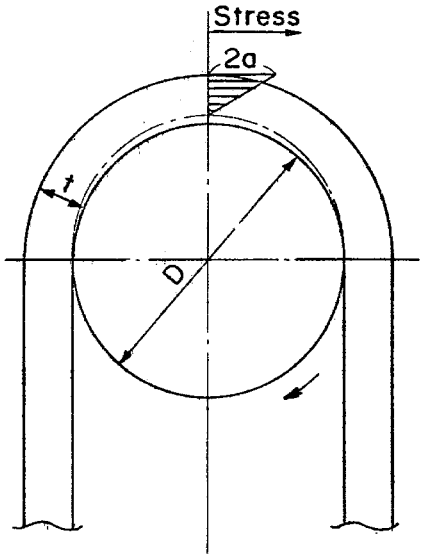

When the strip is passed around the roll, if the neutral axis (shown by the chain line) of bending of the strip coincides with the central line of the strip thickness, as shown in FIG. 4(*a*), the coefficient $\alpha$ is 2, and if the neutral line nearly coincides with the strip surface contacting the roll surface, as shown in FIG. 4(*b*), the coefficient $\alpha$ is 1. The hatched portions in FIG. 4(*a*) and FIG. 4(*b*) represent the occurence of stress in the strip on the vertical line through the center of the roll.

The position of the neutral axis of bending as described above is determined by the friction conditions between the strip and the roll.

The factors having an influence on the friction conditions are the yield point of the steel of the strip at the temperature to which strip is exposed, the surface roughness of the roll and the surface roughness of the strip. Among such factors, however, the yield point is the most impotant.

Since the yield point is proportional to the strip temperature, the position of the neutral axis is almost entirely determined by the strip temperature. When the strip temperature is about 50° C. or lower, the neutral axis of bending is as shown in FIG. 4(*a*), and hence $\alpha=2$. When the strip temperature is relatively high, say about 200° C. or higher, the neutral axis of bending shifts to the position as shown in FIG. 4(*b*), and hence $\alpha=1$ (as already mentioned, this principle was also taken into consideration in determining Formulas [I] and [II]). When the strip temperature exceeds 200° C., no buckling phenomenon is observed.

As a specific illustration, when a Si-Mn dual-phase hot rolled steel strip 3 mm thick (E=21000 kg/mm$^2$, $\sigma_Y$=35 kg/mm$^2$, S=2.0 kg/mm$^2$, $\alpha=2$) is being treated, the diameter of the hearth roll calculated from Formula [III] is 1000 mm or larger.

Regarding the height of the vertical type heating furnace as described hereinbefore, if the height is too small, the advantage, in terms of cost, obtained from the use of a vertical type construction cannot be obtained, while if the height is too great, the cost becomes great due to the required furnace structure, and the tension imposed on a thick and wide strip near and around the upper hearth rolls, due to the weight of the strip hanging from the portions passing over the hearth rolls, becomes too large so that the rolls and/or the strip are damaged. Therefore, it is important to select the proper furnace height. A preferred furnace height is about 15 to 20 m as measured between the centers of the lower and upper hearth rolls.

The vertical heat treating furnace as described above constitutes the main part of the apparatus according to the present invention which, as further equipment, can further include the uncoiler 1, the inlet-end shearing machine 2, the welder 3 and the inlet-end looper provided in succession to constitute the inlet-end connecting section. When a cold rolled steel strip is to be treated, for removing the cold rolling lubricant adhering to a cold rolled steel strip, a rinsing section and necessary auxiliary equipment may be provided.

Regarding the welder used in the present invention, the following considerations must be taken into account.

In the vertical type furnace, because the steel strip is subjected to repeated bending around the upper and lower hearth rolls, the welded portion of the strip entering the furnace must also stand up under repeated bending, and at the same time it must be stepless so as to avoid causing damage to the hearth rolls at the high temperature existing in the furnace. Therefore, when steel strips having a wide range of thicknesses (for example 0.3 to 3 mm) are treated, a welder which can weld together the overlapping portions of the end portion of a preceding strip and the forward portion of a subsequent strip and can mash the overlapping portions flat is preferable, and thus a mash-seam welding machine, for example, is recommended as the welding machine.

For the inlet-end looper, a vertical type strand looper or a horizontal type loop car (arranged beneath the furnace) having a larger-diameter hearth roll to avoid buckling is employed and a large-diameter hearth roll is also used on the inlet end of the heating zone to avoid buckling.

As further equipment on the outlet end of the heat treatment furnace, there are the outlet-end looper 9, the inspecting section 10, the oil coater 11, the outlet-end shearing machine 12, and the coiler 13 arranged in series to constitute the outlet-end connecting section. For the outlet-end looper, free looping as shown in FIG. 1 may be sufficient when the shearing time in the outlet-end shearing machine is relatively short.

When the apparatus according to the present invention is used for treatment of grades of steel which require good flatness and paintability, a rolling mill stand for applying a light reduction may be annexed to the furnace in order to correct the shape of the strip and provide the strip with a surface roughness suited to paint coating. In such a case, it is necessary to provide the rolling stand with a device for rapid exchange of the work roll and to provide an outlet-end looper having enough capacity to provide the time required for roll exchange (1 to 2 minutes). For this outlet-end looper, there can be used a horizontal type loop car or a vertical type strand looper equipped with a larger diameter roll, similar to the hearth rolls in the cooling zone of the heat treatment furnace, for avoiding work hardening of the strip. The horizontal type loop car is preferred because it makes the production line shorter. A leveler may be provided for the purpose of shape correction, and for correction shape defects (for example, cross-buckle) caused by the light reduction rolling mill stand, a series of levelers are sometimes provided.

When the temper rolling mill stand is annexed to the furnace as described above, the strip must be cooled to about 40° C. in order to avoid formation of a thermal crown on the work roll. For this purpose, a third cooling zone is preferably annexed to the secondary cooling zone.

For the third cooling zone, there can be used a vertical type furnace equipped with a gas jet cooler, or a water cooling tank supplied with cold water from a refrigerator. In the latter case, a drying device is provided.

The apparatus for continuously producing a dual-phase high tensile strength steel according to the present invention as described above has a great industrial advantage in that the furnace length can be shortened even for high speed mass production lines and an acid pickling line, which causes operational problems, is not required so that the production line can be made compact.

Operational examples of the present invention will be described hereinbelow.

EXAMPLE 1

A hot rolled strip (3.5 mm×930 mm) of a low-carbon Si-Mn steel (C: 0.10%, Si: 0.51%, Mn: 1.48%, P: 0.012%, S: 0.006%, Al: 0.030%; balance Fe) was cold rolled at a 65% reduction into a cold rolled strip (1.2 mm ×930 mm). This cold rolled strip was treated in the apparatus according to the invention by being heated to 800° C. in one minute or less in the heating zone, subjected to soaking at 800° C. for 90 seconds, cooled to 200° C. at an average cooling rate of 20° C./second in the primary cooling zone, further cooled to room temperature in the secondary cooling zone and then taken out of the furnace.

According to formulas [I] and [II], the diameter of the hearth rolls in and after the primary cooling zone and the diameter of the rolls in the further equipment were 600 mm.

The resultant steel strip had a dual-phase structure and the mechanical properties were as follows:

Tensile strength: 64.0 kg/mm$^2$;
Yield point: 31.4 kg/mm$^2$;
Yield ratio: 49%;
Elongation: 30.0%.

EXAMPLE 2

A hot rolled strip (3.0 mm ×930 mm) of a low-carbon vanadium-containing steel slab (C: 0.11%, Si: 0.40%, V: 0.05%, Mn: 1.60%, P: 0.08%, S: 0.004%, Al: 0.025%, N: 0.001%, balance Fe). The strip was treated in the apparatus of the invention by being heated to 910° C. in 9 minutes or less in the heating zone at a running speed of 50/minute, subjected to soaking at 910° C. for 6 minutes in the soaking zone, then cooled to 600° C. at a cooling rate of 5° C./second in the primary cooling zone, further cooled to 150° C. in the secondary cooling zone, and taken out of the furnace.

According to formulas [I] and [II], the roll diameter in the primary cooling zone and thereafter was 1500 mm, and the roll diameter in the further equipment at the outlet end was 800 mm.

The resultant steel strip had a dual-phase structure and had the following mechanical properties:

Tensile strength: 68.5 kg/mm$^2$;
Yield point: 34.9 kg/mm$^2$;
Yield ratio: 51%;
Elongation: 25.5%.

EXAMPLE 3

A hot rolled strip (3.0 mm ×930 mm) of an Al-Si killed steel slab having a tensile strength level of 55 kg/mm$^2$ (C: 0.089%, Si: 0.437%, Mn: 1.54%, P: 0.015%, S: 0.005%, Al: 0.023%; balance Fe) was treated in the apparatus of the invention by being heated to 759° C. in 3 minutes or less in the heating zone at a running speed of 150 m/minute, then subjected to soaking at 750° C. for 2 minutes in the soaking zone, cooled to 300° C. at a cooling rate of 15° C./second in the primary cooling zone, further cooled to 90° C. in the secondary cooling zone and taken out of the furnace.

According to formulas [I], [II] and [III], the roll diameter at the entry end and the diameter of the hearth rolls in the heating zone was 800 mm, while the diameter of the hearth rolls in the primary cooling zone was 1500 mm and the roll diameter in the further equipment on the outlet end was 800 mm. The tension of the steel strip was 1 to 1.5 kg/mm$^2$.

The steel strip thus treated developed a dual-phase structure and had the mechanical properties shown below (according to JIS No. 5 test piece, in the transverse direction). The mechanical properties of a comparative 55 kg/mm$^2$ grade steel as hot rolled are shown in parentheses.

Tensile strength: 56 kg/mm$^2$ (57 kg/mm$^2$);
Yield point: 34 kg/mm$^2$ (40 kg/mm$^2$);
Yield ratio: 60% (70%);
Elongation: 32% (32%).

On the other hand, another hot rolled strip having the same chemical composition as that described above was treated according to the same annealing cycle as described above in another line, in which the roll diameter at the entry section was 500 mm, the hearth roll diameter in the heating zone was 762 mm, the hearth roll diameter in the cooling zone was 356 mm and the roll diameter at the delivery section was 500 mm. The steel strip thus treated developed a dual-phase structure, but unlike the above described hot rolled steel strip, its mechanical properties, as shown below, did not have the feature of low yield ratio.

Tensile strength: 57 kg/mm$^2$;
Yield point: 41 kg/mm$^2$;
Yield ratio: 72%;
Elongation: 29%.

Furthermore, the thus treated strip suffered from buckling due to the small diameter of the rolls in the entry section.

As will be clearly understood from the foregoing operational examples, the apparatus according to the present invention makes possible commercial mass production of dual-phase hot and cold rolled steel strips with a low yield-to-tensile strength ratio.

What is claimed is:

1. An apparatus for continuously producing a high strength dual-phase steel strip or sheet having a metallurgical composition which produces a dual-phase structure composed of ferrite grains and a low temperature transformed phase when rapidly cooled from the $(\alpha+\gamma)$ temperature range or from the $\gamma$ temperature range, which apparatus comprises a vertical type continuous heat treatment furnace having a heating zone, a soaking zone and a cooling zone, said cooling zone having an upper hearth roll group, a lower hearth roll group and means for cooling the strip at a rate in the range between 1° and 300° C./sec. for retaining the austenite, the hearth rolls of each hearth roll group being positioned for guiding the strip coming from the soaking zone up and down and alternatively around the upper hearth rolls and the lower hearth rolls from the inlet end to the outlet end of the cooling zone, and the hearth roll at the position where the strip is subjected to straining and begins to work harden as a result of the bending and the subsequent hearth rolls having a diameter D in millimeters according to the formula which is for the condition where the strip temperature is greater than 200° C.:

$$\frac{t}{D} + \beta \cdot T \cdot \log(CR) \cdot \frac{1}{100} \leqq \epsilon WH$$

Wherein;

t = Maximum strip thickness in millimeters;

$\epsilon$WH = 0.2% (Strain at which the retained austenite starts to undergo strain induced transformation into martensite and the strip begins to work harden);

$\beta$ = Linear thermal expansion coefficient ($12 \times 10^{-6}$);

T = Temperature at which the strip is subjected to cooling, in degrees C;

CR: Cooling rate of the strip in degrees/second. whereby the strain induced phase transformation of the retained austenite and consequently the work hardening of the strip when it is passed around the hearth rolls is avoided.

2. An apparatus according to claim 1 in which said further equipment includes looper rolls and bridle rolls, and said looper rolls and bridle rolls have a diameter D′ in millimeters according to the formula which is for the condition where the strip temperature is less than 200° C.:

$$\frac{t}{2D'} + \beta \cdot T \cdot \log(CR) \cdot \frac{1}{100} \leqq \epsilon WH$$

wherein;

t = Maximum strip thickness in millimeters;

$\epsilon$WH = 0.2% (Strain at which the retained austenite starts to undergo strain induced transformation into martensite and the strip begins to work harden);

$\beta$ = Linear thermal expansion coefficient ($12 \times 10^{-6}$);

T = Temperature at which the strip is subjected to cooling, in degrees C;

CR = Cooling rate of the strip in degrees C/second.

3. An apparatus according to claim 2 in which said further equipment comprises a looper having a guide roll and positioned at the inlet end of said heating zone, and the heating zone comprises means for heating the strip, an upper hearth roll group and a lower hearth roll group, the hearth rolls of said hearth roll groups being positioned for guiding the strip being continuously supplied into the heating zone up and down and alternately around the upper hearth rolls and the lower hearth rolls from the inlet end to the outlet end of said heating zone, and the guide roll of said looper and the hearth rolls at the inlet end of said heating zone before the zone at which the strip is heated to 200° C. in the heating zone have a diameter D″ in millimeters according to the formula:

$$\frac{D''}{t} \geqq \frac{E}{\alpha(\sigma_Y - S)}$$

wherein;

t = Maximum strip thickness in millimeters;

E = Young's modulus;

$\sigma_Y$ = Yield stress of the strip

S = Tension of the production line in kg/mm$^2$;

$\alpha$ = Coefficient (1 or 2 according to the friction conditions between the strip and the guide roll or the hearth rolls).

* * * * *